US007281289B1

(12) United States Patent
Mirza et al.

(10) Patent No.: US 7,281,289 B1
(45) Date of Patent: Oct. 16, 2007

(54) AUTOMATIC PRESSURE RELEASE TOOTHBRUSH

(75) Inventors: Zubair Mirza, Elmwood Park, NJ (US); Ingram S. Chodorow, Rancho Santa Fe, CA (US)

(73) Assignee: Placontrol, Inc., San Diego, CA (US)

( * ) Notice: Subject to any disclaimer, the term of this patent is extended or adjusted under 35 U.S.C. 154(b) by 0 days.

(21) Appl. No.: 09/583,626

(22) Filed: May 31, 2000

Related U.S. Application Data

(60) Provisional application No. 60/154,418, filed on Sep. 17, 1999.

(51) Int. Cl.
*A46B 9/04* (2006.01)

(52) U.S. Cl. ..... 15/167.1; 15/144.1; 15/172

(58) Field of Classification Search ..... 15/143.1, 15/144.1, 144.2, 167.1, 172, 201
See application file for complete search history.

(56) References Cited

U.S. PATENT DOCUMENTS

| | | | | | |
|---|---|---|---|---|---|
| 1,732,508 | A | * | 10/1929 | Farris | 15/144.1 X |
| 2,216,026 | A | | 9/1940 | Smith | 15/144.1 |
| 3,493,991 | A | | 2/1970 | De Bianchi | 15/143.1 |
| 4,731,896 | A | * | 3/1988 | de La Tour | 15/167.1 X |
| 5,146,645 | A | | 9/1992 | Dirksing | 15/167.1 |
| 5,282,291 | A | * | 2/1994 | Spieler et al. | 15/167.1 |
| 5,315,732 | A | | 5/1994 | Heufner et al. | 15/167.1 |
| 5,355,544 | A | | 10/1994 | Dirksing | 15/105 |
| 5,406,664 | A | | 4/1995 | Hukuba | 15/22.1 |
| 5,412,827 | A | * | 5/1995 | Muller et al. | 15/167.1 X |
| 5,467,494 | A | * | 11/1995 | Muller et al. | 15/167.1 X |
| 5,707,166 | A | | 1/1998 | Jeannet et al. | 403/24 |
| 6,003,189 | A | * | 12/1999 | Falleiros | 15/167.1 |

FOREIGN PATENT DOCUMENTS

| | | | | |
|---|---|---|---|---|
| DE | 3724476 | * | 1/1989 | 15/167.1 |
| FR | 1227009 | * | 2/1960 | 15/172 |

* cited by examiner

*Primary Examiner*—Mark Spisich
(74) *Attorney, Agent, or Firm*—Abelman, Frayne & Schwab

(57) ABSTRACT

A toothbrush operable by a user has a handle having a distal end, a head having a proximal end extending from said handle's distal end and bristles extending generally in a first direction designated "forward". The head has a first orientation relative to the handle when the head is relaxed, the head being pivotable relative to said handle out of the first orientation to a second orientation rearward of the first orientation, when a force greater than a predetermined threshold level is applied to the head in a direction generally opposite the first direction. The head remains out of the first orientation until it is manually returned by the user to the first orientation.

9 Claims, 10 Drawing Sheets

Fig. 4e
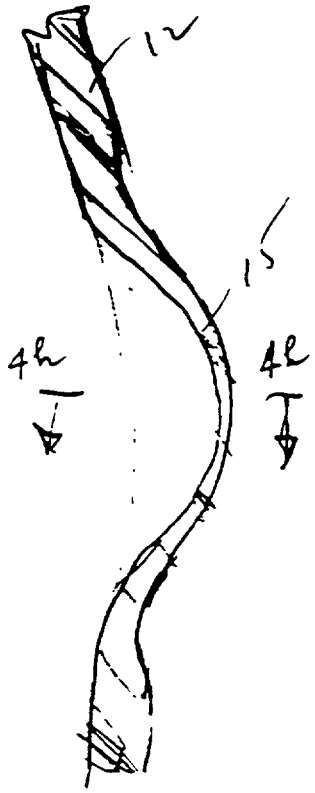
Fig. 4f
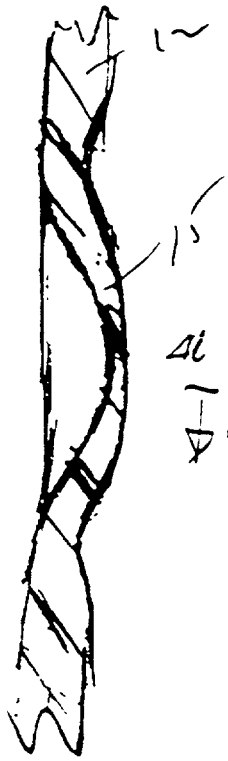
Fig. 4g
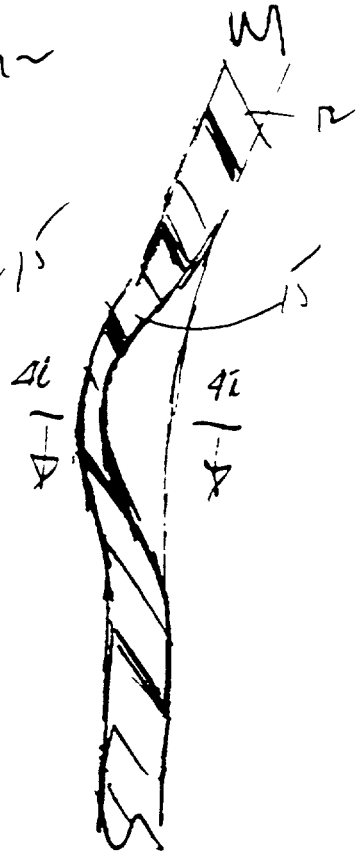
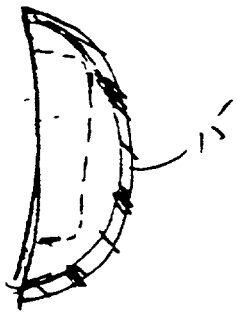
Fig. 4h
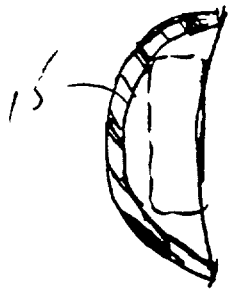
Fig. 4i 68
11B
FRONT STOP
64'
67a
67b
(ALT.)
11B
50
61
61
65
(ALT.)
64
65B
64
63
62
RAISED BALL 66
67a
67b

AUTOMATIC PRESSURE RELEASE TOOTHBRUSH

CROSS REFERENCE TO RELATED APPLICATION

This application is based on and claims priority of U.S. Provisional Patent Application No. 60/154,418 filed Sep. 17, 1999, entitled AUTOMATIC PRESSURE RELEASE TOOTHBRUSH

BACKGROUND

1. Field of the Invention

This invention is in the field of toothbrushes, particularly typical toothbrushes where the user applies oscillating, linear, circular and other motions along with varying amounts of axial pressure of the bristles on the tooth and gum surfaces.

2. Background of the Invention

It is well accepted that regular brushing of the teeth along with flossing, dental examinations, and other appropriate care is essential to maintain healthy teeth and gums or to at least to minimize deterioration. In this regard hundreds of millions of toothbrushes are used regularly throughout the world.

A variety of new toothbrush designs have been periodically introduced into the oral care market with new features that improve performance or ergonomics. Some of the many new designs included different angles of the head and/or the bristles, different tuft designs, varying hardness and stiffness of the bristles, and even wear markers either on the handle or in the bristles to indicate fatigued bristles and to signal the time to replace the toothbrush. Also, in recent years mechanized toothbrushes have been introduced which move bristles in various circular or transverse motion patterns, and also axially at extremely high speeds.

Many of these toothbrushes represented significant advances. However, one particular issue or problem persists and has led to proposed solutions which run the gamut of extremes. This is the issue of how stiff and/or hard the bristles should be to adequately clean the teeth without damaging the enamel surface of the teeth.

About twenty-five years ago hard or stiff bristles were preferred, because soft and medium bristles were considered too weak to achieve adequate cleaning. Makers of brushes with natural bristles proclaimed their products safer and superior to nylon and other plastic bristles. More recently, soft bristles have been generally considered by dentists as the only safe bristles to use to avoid both enamel and gum damage.

The debate remains unresolved as to which of the above toothbrushes is best; however, a vast number of people continue to suffer from worn enamel and/or bleeding or sore gums because of the toothbrushes or brushing techniques they use. Thus, none of these dental developments has adequately solved the above discussed problems of damaged enamel and gums caused by the toothbrushes or brushing techniques.

SUMMARY OF THE INVENTION

The present invention (a) recognizes the failure of the oral care industry to develop a toothbrush with ideal bristles that are best or safest with regard to enamel and/or gum damage, and (b) proposes a totally different approach that solves the problem and is applicable with all or most existing toothbrushes.

The issue the present invention addresses is excessive pressure applied to the teeth and gum surfaces during brushing. All of the attempted solutions with different bristle materials, tuft patterns, varying stiffness and handle ergonomics fail to deal with the fundamental fact that users of toothbrushes apply by their own hands uncountable variations in pressure of the bristles onto their own teeth. Not only does each person exert a different force, each person will vary his or her force depending on the angle of the hand holding the brush as different areas of the mouth are brushed. So, a medium bristle may be applied very hard in some areas, or a hard or medium bristle may be pressed inadequately to properly clean. There is no way to effectively teach people exactly how hard to press the tuft or bristles against the teeth and gums, and because of varying angles of toothbrushes and arm and finger positioning any attempted pressure level could not be maintained constant anyway.

The new toothbrush invention includes a hinge between the handle and the head with its bristles. When light to moderate pressure is applied it performs like all other toothbrushes. When the pressure of the bristles on the teeth is excessive according to a predetermined safe level of pressure, the hinge automatically releases the head causing it to bend backward, in a direction away from the teeth.

The hinge has a preset pressure threshold. In typical toothbrush use a person holds the handle and through the handle and the head at the end thereof, applies pressure of the bristles onto the teeth. It is basic mechanics that the pressure applied by the bristles is experienced by the head of the toothbrush and by the hinge to which the head is coupled. When this pressure reaches the predetermined unsafe threshold level, the hinge gives way, and in a preferred embodiment snaps to a new position whereby the head is in an awkward and unusable position, and the user is forced to stop brushing and stop applying the excessive pressure. This alteration of the toothbrush structure remains until the user manually corrects it by snapping or otherwise pushing the head back into its original position.

This elegant and simple solution automatically prevents excessive force from being applied to the teeth and gum surfaces, and more importantly, teaches the user what excessive pressure feels like so that an excessive level of force can be avoided and a correct level learned and maintained. The new hinge can take a variety of forms, the preferred one at present being a bi-stable spring having two positions where the spring is integrally molded with the toothbrush handle and head. This hinge is a type of toggle mechanism whereby the head is biased to go to and remain in either a first position (normal position) or in a second position which is intended to be so awkward that it is essentially un-usable. The transition from first to second position occurs when the user presses the bristles too hard against the teeth. This force is transmitted to the head and thence to the hinge which automatically reverses its configuration and drives the head to said second position. In a variation the hinge would merely release the head from being held in said first position and leave it floppy or loosely attached to the handle. The toothbrush remains essentially unusable until the user manually returns the head back to said first position. This return automatically activates the hinge spring to its first condition wherein it biases the head to stay in said first position until the force on the head again becomes excessive causing the head to snap to said second position.

One preferred embodiment of the hinge uses a rectangular elongated strip of resilient plastic compressed in the longitudinal direction until it bows and functions as a bi-stable spring; another preferred embodiment uses an elongated spoon-like or concave spring of resilient plastic; a third preferred embodiment uses a two-part hinge with a bi-stable biasing spring between these parts.

In all of these configurations the spring will, when excessively stressed, snap to an inverted stressed configuration. Application of such excessive force by the user to the bristles and thence to the toothbrush head will bend the head which is firmly connected to said top end of the hinge that snaps to its second position. Subsequently, the head is either manually forced back to its first, normal position, or it can be designed to return automatically after a predetermined time period.

Preferred embodiments of this invention will be described below with reference to the appended drawings.

BRIEF DESCRIPTION OF THE DRAWINGS

FIGS. 4*e*-4*g* show enlarged view of the spring of FIGS. 4*b*-4*d*. FIGS. 4*h* and 4*i* show cross-sections of the spring in FIGS. 4*e* and 4*g* respectively of the spoon type bi-stable spring.

DETAILED DESCRIPTION OF THE PREFERRED EMBODIMENTS

Figure 3:
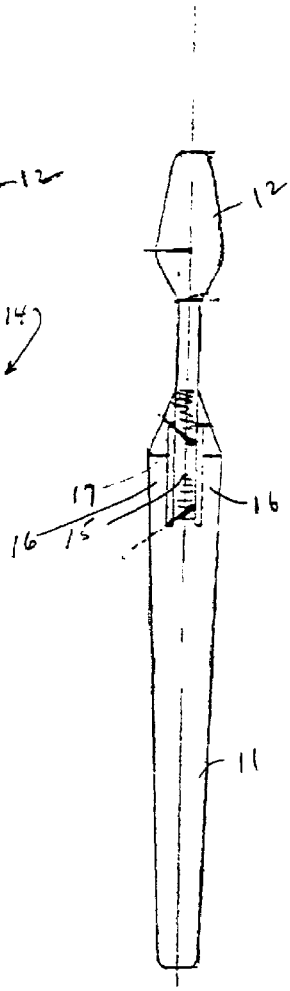
FIG. 3 is a front elevation view thereof.
Figure 4:
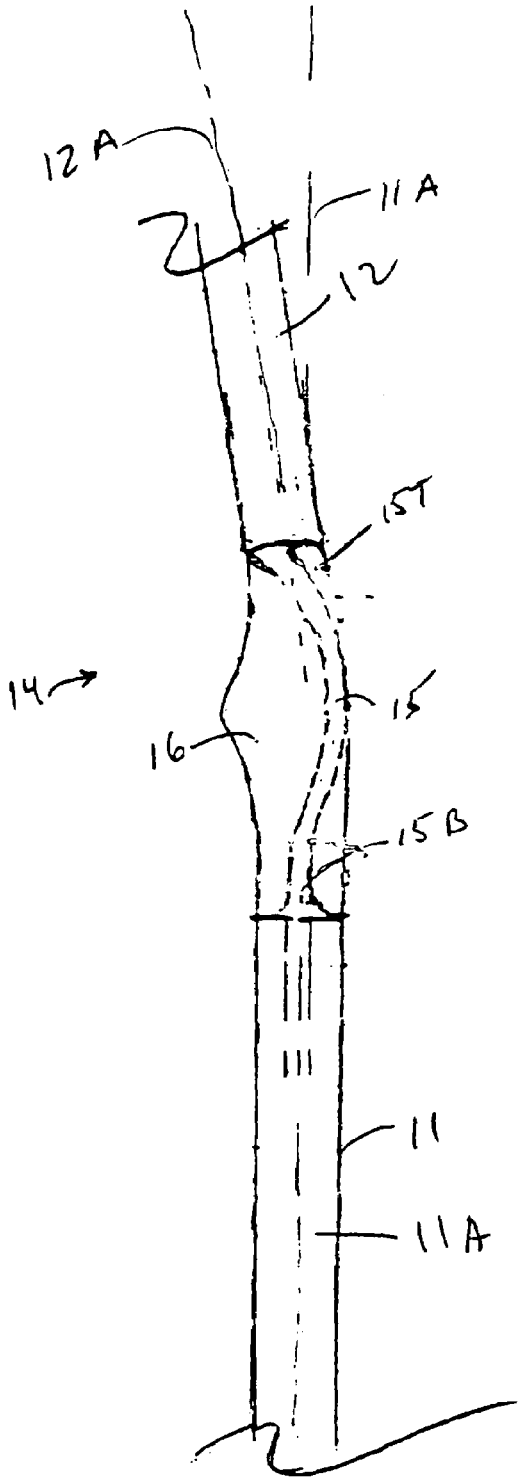
FIG. 4 is a fragmentary sectional view taken along line 3-3 in FIG. 2.

The first embodiment 10 of the new toothbrush is seen in FIGS. 1-3, 4 and 4*a*-4*i* consisting of a handle 11, head 12 with bristles 13 and a hinge 14 connecting the head and handle. FIGS. 2-4 show further details of the hinge 14 comprising a central strip 15 having top and bottom ends 15T and 15B respectively and intermediate arch or bow 15C.

Figure 4A:
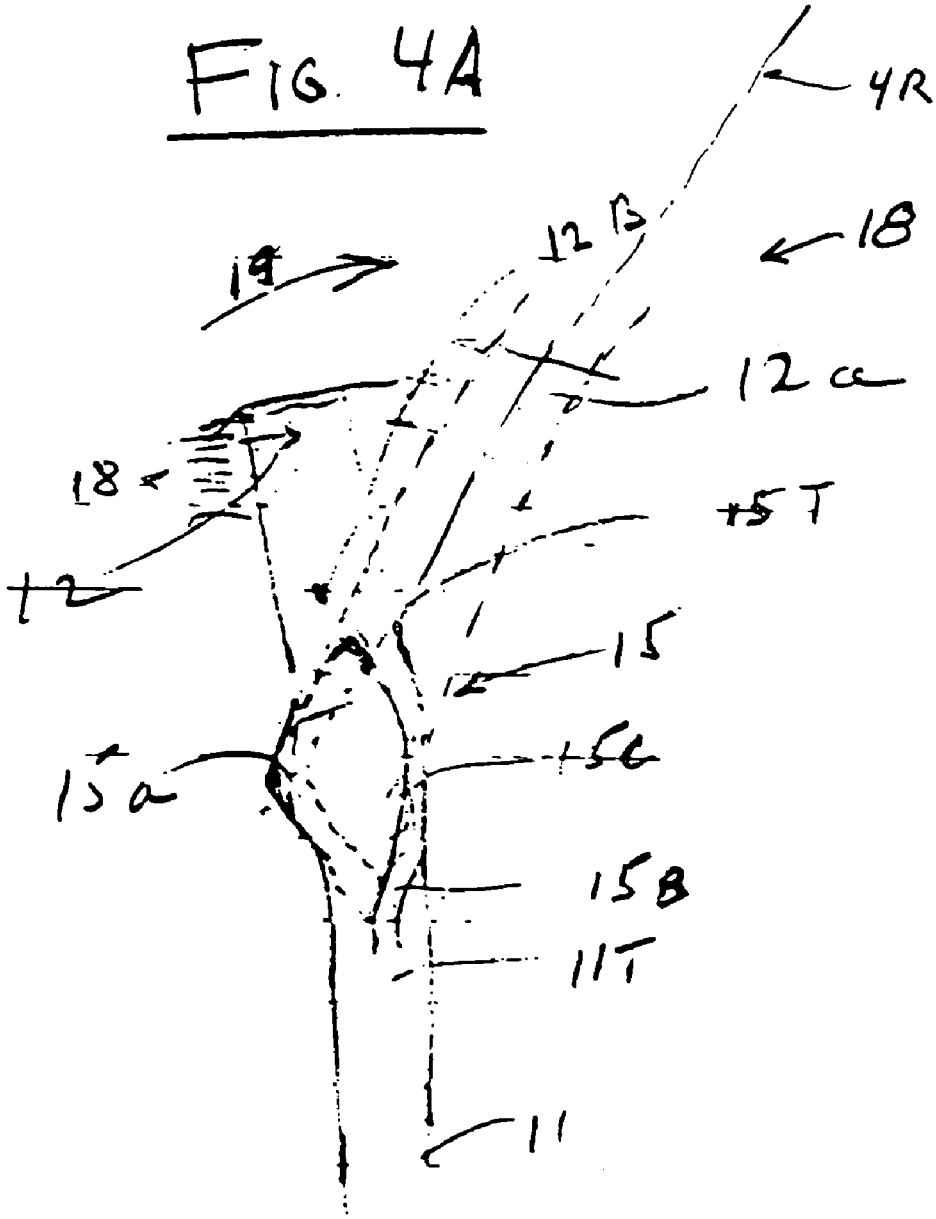
FIG. 4A is a side elevational similar to FIG. 4 but shows the hinge activated and the toothbrush head moved to its second position.

FIG. 3 shows the hinge as essentially three parallel strips, namely central spring strip 15 and adjacent outer strips 16. FIGS. 4 and 4*a* show further details of hinge 14 where the arch or bow spring element 15 is connected by its tip part 15T to the head 12 and by its bottom part 15B to the handle 11. This arch has a bowed configuration because it is in axial compression while the adjacent elements 16 are in tension. The bow is a bi-stable spring which attains a first stable condition or position shown in FIG. 4 with the longitudinal axis 12A of the head angled slightly to the left of the longitudinal axis 11A of the handle, and a second stable condition 18 shown in dotted lines in FIG. 4*a* with the spring element 15 from the right side position in FIG. 4 to the left side position in dotted lines in FIG. 4A, and with the head inclined to the right. This results from a force applied in the rightward direction to the head as indicated by arrow 19.

Figure 1:
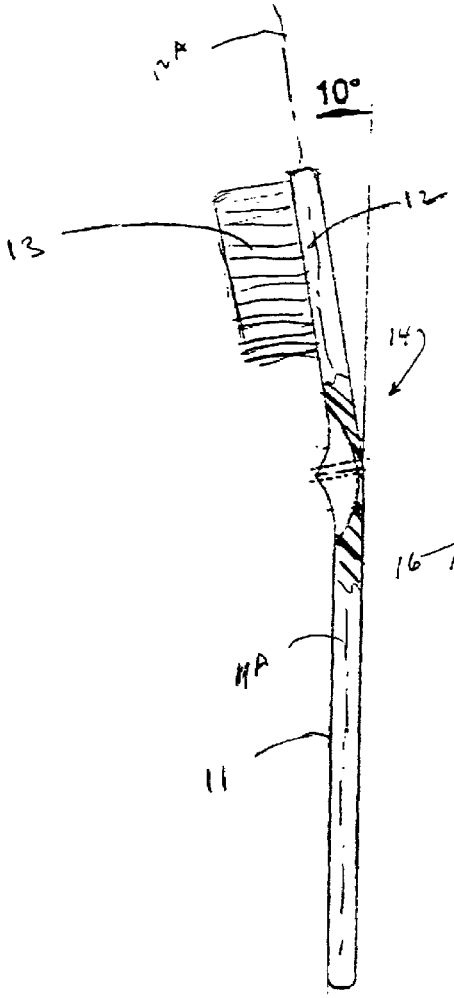
FIG. 1 is a right side elevation view partially in section of a first embodiment of the new invention.
Figure 2:
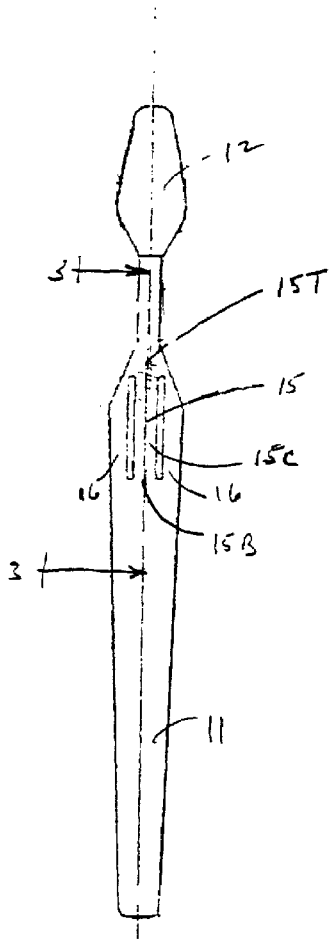
FIG. 2 is a rear elevation view thereof.

Most toothbrushes have the head either coaxial with the handle or angled forward as seen in FIGS. 1 and 4; the rearward angle of the head per longitudinal axis 4R in FIG. 4*a* results in a toothbrush with an awkward configuration which is essentially unusable until the head is returned to its normal position.

Figures 4B, 4C, 4D:
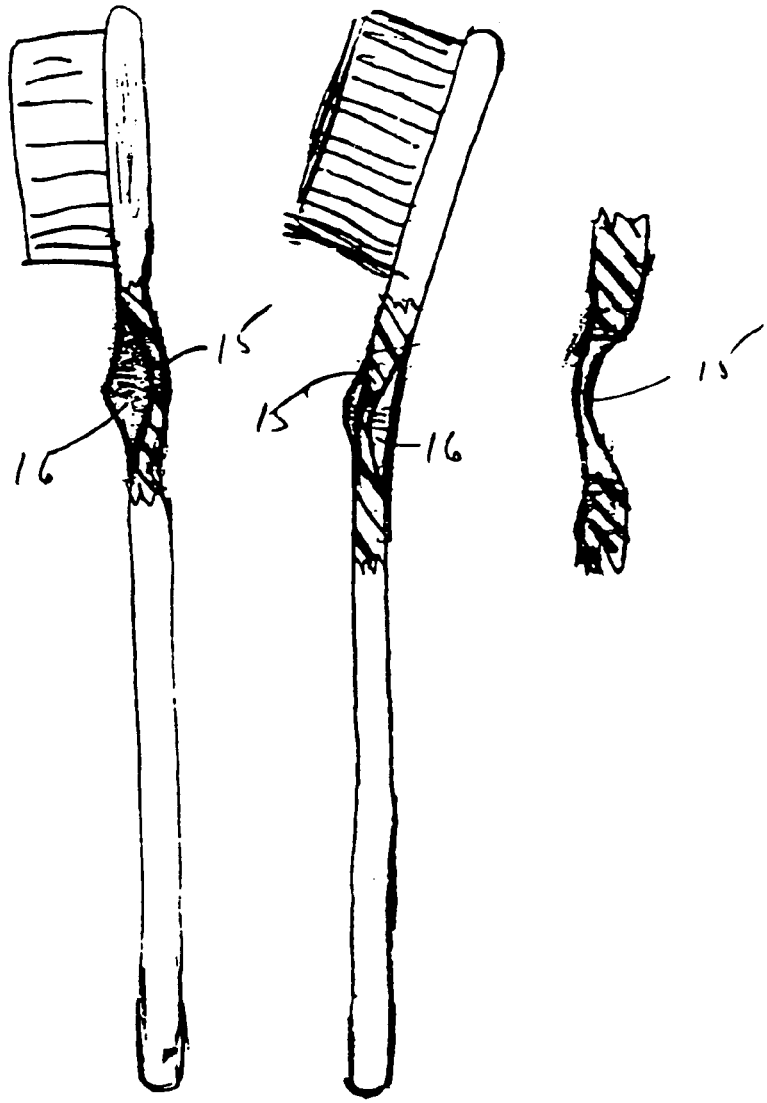
FIGS. 4*b*-4*d* show the toothbrush and spring in a succession of positions as the spring bows from right to left.
Figure 5:
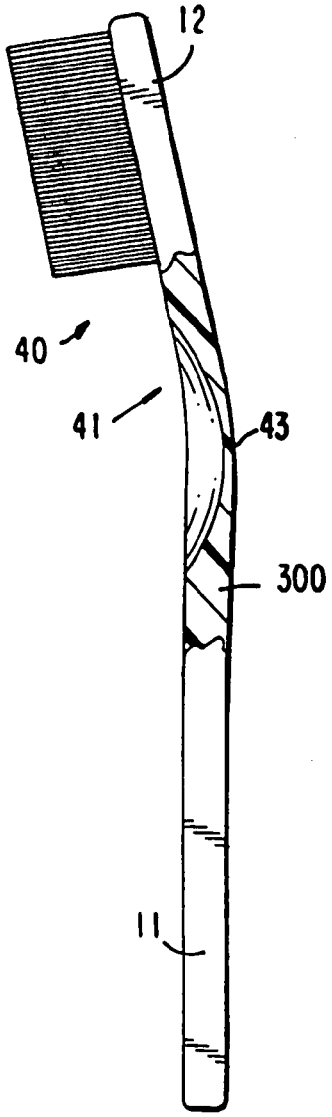
FIG. 5 is a schematic side elevation view similar to FIG. 1 but of a second embodiment.
Figure 6:
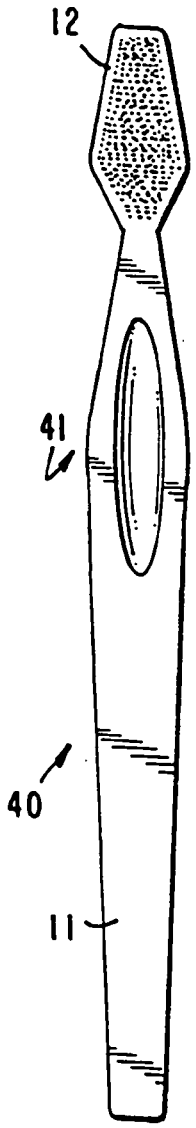
FIG. 6 is a rear elevation view of FIG. 6.
Figure 7:
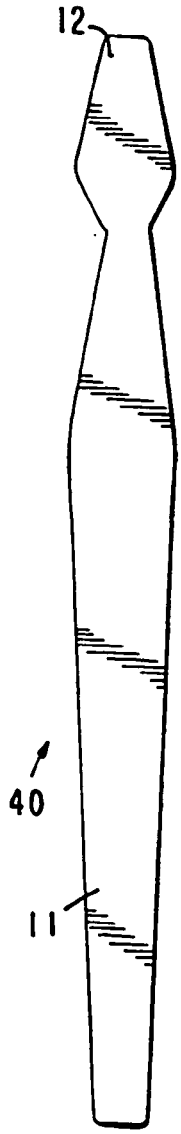
FIG. 7 is a front elevation view of FIG. 6.

FIGS. 4*b* and 4*c* show the toothbrush and spring in a succession of positions where the spring bows from right to the left. FIG. 4*d* shows the spring alone bowed to the left; FIGS. 4*b* and 4*c* show the left side tension element 16. FIGS. 4*e*-4*g* show further details of the spring element through its transition from right to left bowing and the corresponding angular change of the head 12 from left to right. FIGS. 4*h*-4*i* show the cross-sections of FIGS. 4*e* and 4*g* respectively whereby the spring's concavity is reversed.

Figure 8:
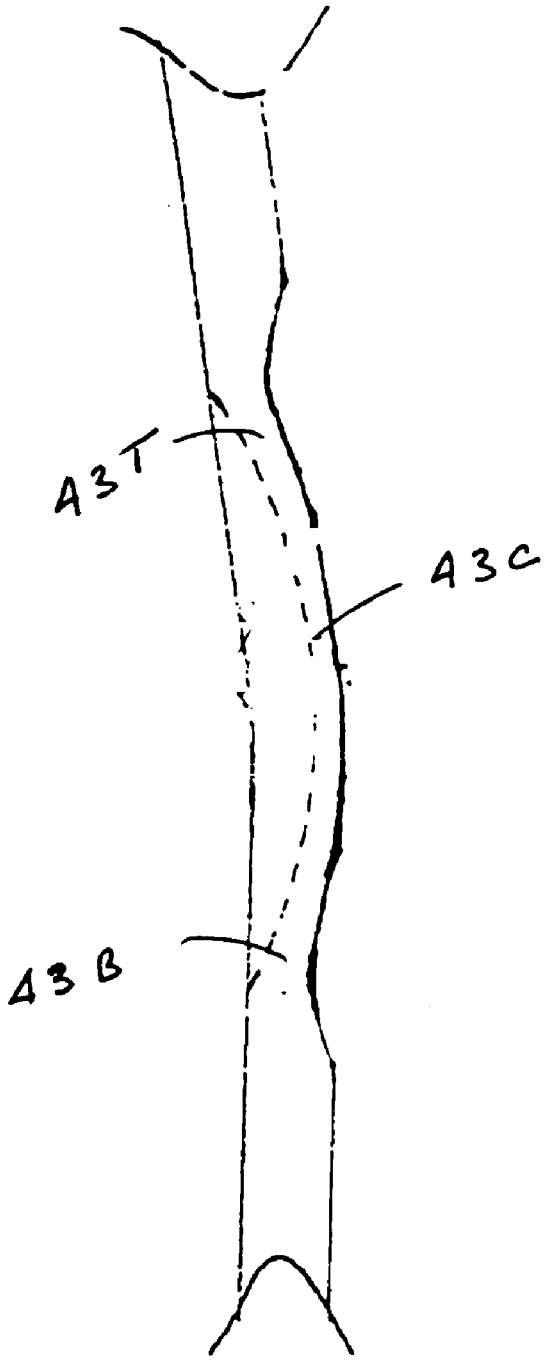
FIG. 8 is a fragmentary side view taken along line 9-9 in FIG. 8.
Figures 9, 10:
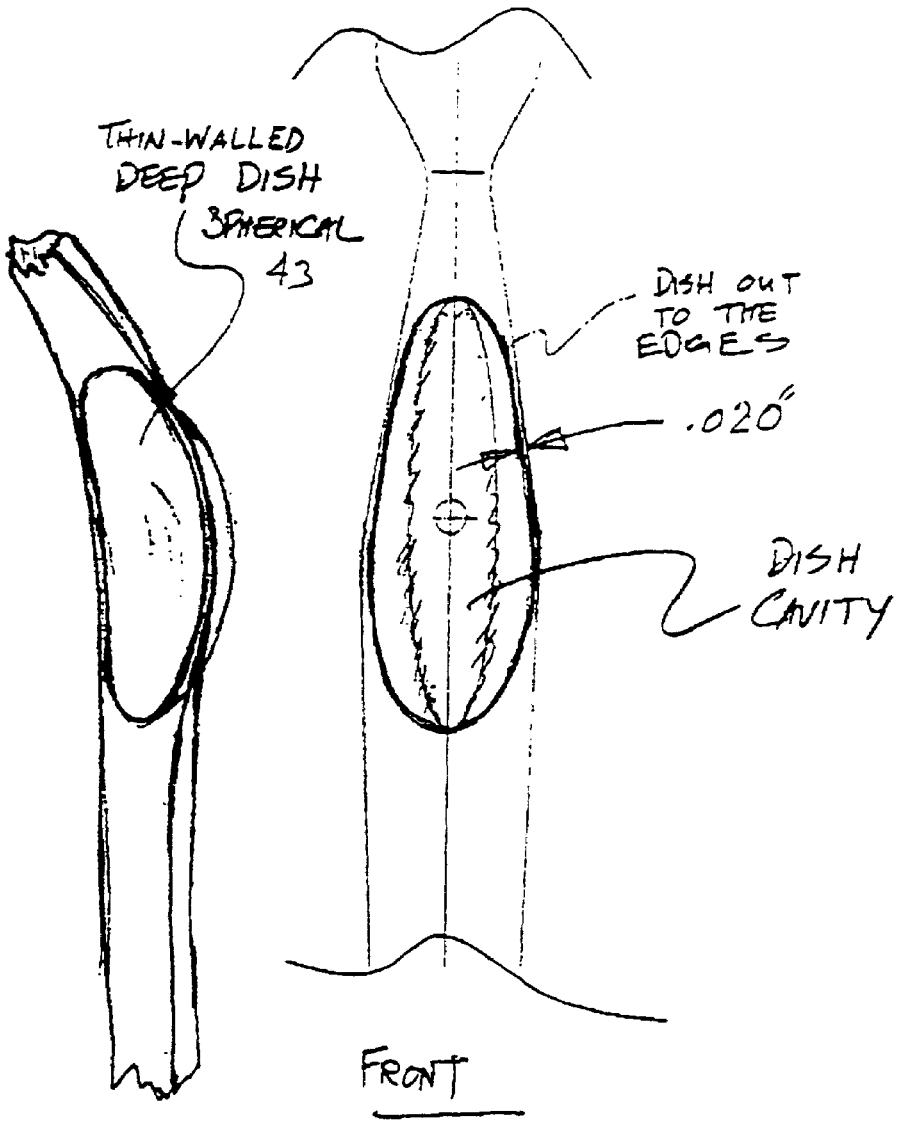
FIG. 9 is a fragmentary front and right side perspective view of the toothbrush of FIGS. 6 and 8.
FIG. 10 is a front elevation view of FIG. 10.

FIGS. 5-10 illustrate a second preferred embodiment which differs from the first embodiment primarily in the configuration of the hinge and spring element. Similar structural elements of the handle, head and bristles will have the same reference numeral designations and new structure will have new reference numbers. In this second embodiment 40 the handle 11 and head 12 are essentially the same as before. The hinge 41 is an elongated concave or spoon shaped elastic element 43 seen most clearly in FIG. 9. FIG. 8 shows how the center area 43*c* of the dish is thinner than the top and bottom ends 43T, 43B respectively. This dish has a thickness of about 0.020 inches on the side edges, about 0.030 inches at the center of the dish, and 0.050 inches at the top and bottom ends where the spring element is thicker where it joins the head and handle respectively. As with the firsts embodiment, excess pressure on the head is translated to the top end 43T of the concave spoon-shaped spring which eventually snaps to inverted convex shape, thus directing the head to its new angled position.

This second embodiment has the advantage of simplicity of structure and economy of manufacture, in addition to operating simply and effectively. As with the earlier-disclosed embodiment, the entire toothbrush handle, hinge and head can be molded in a single cavity mold in a single molding stage. Obviously, these toothbrushes will be manufactured in typical high-speed multi-cavity injecting molding machines, with the bristles incorporated into the toothbrush head in a standard manner.

The third embodiment 50 follows the same principles of operation of the prior embodiments, but utilizes a multi-component hinge as seen in FIGS. 11, 11A, 11B and 12. In this structure the handle 61 defines at its top end a hinge yoke 62 having side walls 63 and a central pivot axis 64. The head 65 has the same pivot axis 64 and a pivot axle not shown through said axis 64.

At the bottom end 65B of the head is a detent or spring biased ball 66 (see FIG. 11A) that extends outward and engages recesses or holes 67*a*, 67*b* in the yoke. When ball 66 is in recess 67*a* the head is inclined to the left in its position for normal operation. When the bristles are pressed excessively hard on the teeth or gum, force is applied in the direction of arrow 68 (FIG. 11) which pivots the head clockwise about the handle within yoke 62 until ball 66 engages recess 67*b*. In this configuration the toothbrush would be unusable, and thus the teeth enamel would be protected from further excessive abrasion.

In this embodiment the detent is designed to release the head to pivot only when the force per arrow 68 is sufficient to overcome a pre-set threshold resistance limit of the detent. If the pre-set threshold is set at 6 ounces, then any force greater than 6 ounces will cause pivoting of the head. In a variation of this embodiment the threshold force will be about 2-12 ounces.

Figures 11, 11A, 11B:
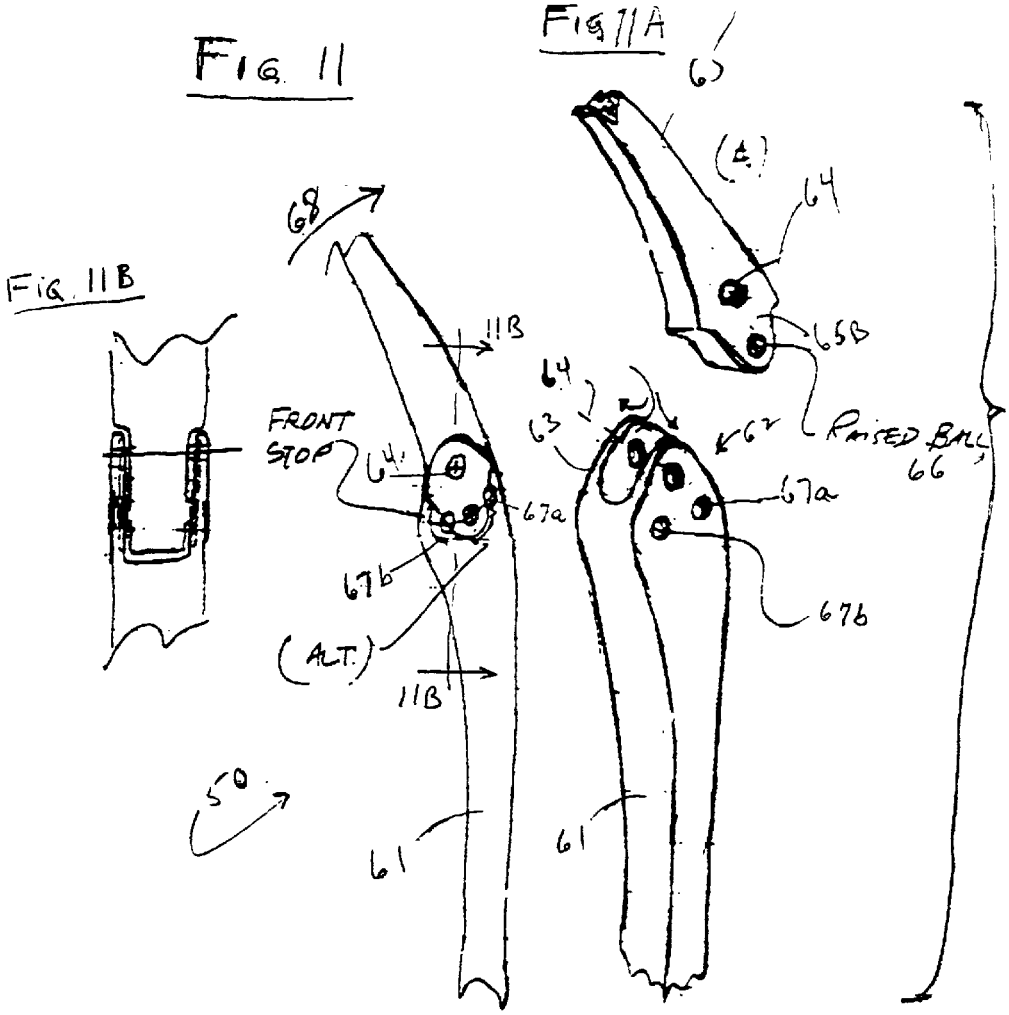
FIG. 11 is a cutaway right side elevation view of a fourth embodiment of the new toothbrush with a multiple component hinge.
FIG. 11A is an exploded perspective view of the hinge of FIG. 11.
FIG. 11B is a fragmentary section taken through FIG. 11, and FIGS. 12A and 12B are fragmentary side elevation views of a fifth embodiment showing it in two positions.

A variation of the embodiment of FIG. 11 will have a detent 66 as shown but only one recess 67*a*. When the detent is in recess 67*a* the head will be in the initial and proper orientation relative to the handle. When the head is forced out of this position and the detent is driven out of recess 67*a*, the head will be free to "flop" backward. In one version there will be a stop to limit the backward movement of the head. In this embodiment the movement of the head from its initial or first orientation to its second and inoperable orientation relative to the handle will be at least 10°; in another embodiment the second orientation may be about 20°. In either case the head will pivot but not snap to an unusable orientation until it is manually pushed back to its initial position. In these embodiments the head either remains in its initial position until the threshold force is exceeded, or the head flexes proportionately to the applied force but does not release until the threshold is reached.

Figure 12A:
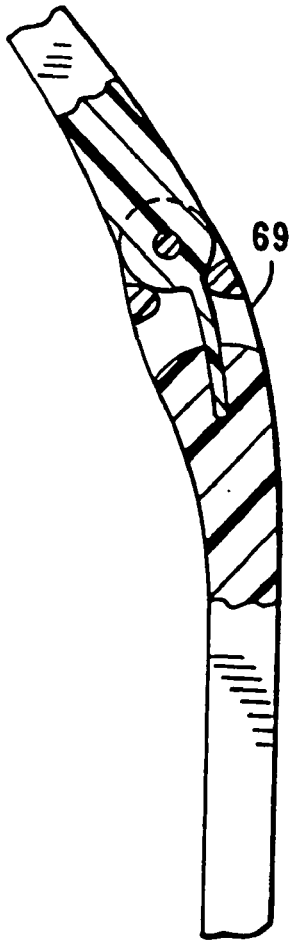
Figure 12B:
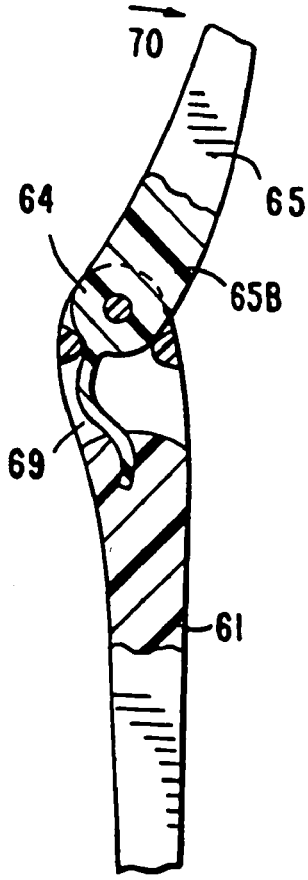

FIG. 12, parts (a) and (b) shows a variation where there is the same yoke 62 and tongue 65B as in FIGS. 11 and 11A and the same pivot axis 64; however, instead of spring action by the ball detent in FIGS. 11 and 11A, there is a flexible flat spring 69 which flips or snaps from being concave facing left (part a) to being concave facing right (part b) when the toothbrush head 65 pivots per arrow 70 similarly as the spring in the first embodiment disclosed herein.

All of these embodiments and other variations within the scope of this invention apply the principle of altering the position or orientation of the toothbrush head when excessive force is being applied by the bristles to the teeth or to the gums.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

The invention claimed is:

1. A toothbrush comprising:

a—a handle part having proximal and distal ends and a longitudinal axis therebetween, the distal end of the handle part including a hinge yoke defined by a pair of spaced walls;

b—a head part having proximal and distal ends, a longitudinal axis therebetween and a set of bristles having exposed tip portions extending in a forward direction;

c—the proximal end of the head part being received between the spaced walls of the hinge yoke and further wherein the head part is coupled to the handle part to move about a pivot axis, the proximal end of the head part including a retaining means in the form of a detent or a spring-biased ball, said retaining means being spaced from the pivot axis at the proximal end of the head part, the distal end of the handle part further including means in the form of a single recess or hole for cooperating with the retaining means of the head part to retain the head part in a normal use position relative to the handle part, the head part in the use position being oriented at a predetermined first angle relative to the longitudinal axis of the handle part with the head part remaining in the use position until the application of a predetermined excessive force to the bristles in a rearward direction; and, d—upon the application of the predetermined threshold level of force to the bristles, the head part moves from the normal use position about the pivot axis to a second position at an acute angle inclined in the rearward direction relative to the longitudinal axis of the handle part, the cooperating means of the handle part and head part being limited to the normal use position such that the head part may be free to flop backward from the normal use position to the second position, the head part being entirely unrestrained between the two positions such that the toothbrush is rendered inoperative upon the application of excessive force to the bristles.

2. A toothbrush according to claim 1 wherein said predetermined threshold level of force in the range of about two to twelve ounces.

3. A toothbrush according to claim 2 wherein said predetermined threshold level of force is about six ounces.

4. A toothbrush according to claim 1 wherein said released head part is manually movable back to said use position, at which time said retaining means will automatically engage and releasably hold said head part in said use position.

5. A toothbrush according to claim 1 wherein said head part's longitudinal axis in said second position is inclined rearward of said handle's longitudinal axis by about 20°.

6. A toothbrush comprising:

a—a handle part having proximal and distal ends and a longitudinal axis therebetween, the distal end of the handle part including a hinge yoke defined by a pair of spaced walls;

b—a head part having proximal and distal ends, a longitudinal axis therebetween and a set of bristles having exposed tip portions extending in a forward direction;

c—the proximal end of the head part being received between the spaced walls of the hinge yoke and further wherein the head part is coupled to the handle part to move about a pivot axis, the proximal end of the head part including a retaining means in the form of a detent or a spring-biased ball, said retaining means being spaced from the pivot axis at the proximal end of the head part, the distal end of the handle part further including means in the form of a pair of spaced recesses or holes for cooperating with the retaining means of the head part to retain the head part in one of two positions, the head part being retained in a first normal use position relative to the handle part when the retaining means of the head part is engaged with one of the recesses or holes of the handle part, the head part in said use position being oriented at a predetermined first angle relative to the longitudinal axis of the handle part with the head part remaining in said use position until the application of a predetermined excessive force to the bristles in a rearward direction; and d—upon application of the predetermined threshold level of force to the bristles, the head part moves from said normal use position about the pivot axis to a second and inoperative position at an acute angle inclined in the rearward direction relative to the longitudinal axis of the handle part, the head part being retained in the second position by engagement of the head part retaining means with the other of the recesses or holes of the handle part, the cooperating means of the handle part and head part being limited to only the first and second positions such that the head part is entirely unrestrained between the two positions.

7. A toothbrush according to claim 6 wherein said predetermined threshold level of force is in the range of about 2 to 12 ounces.

8. A toothbrush according to claim 7 wherein said force is about six ounces.

9. A toothbrush according to claim 6 wherein said head part's longitudinal axis in said second position is inclined rearward of said handle's longitudinal axis by about 20°.

* * * * *